US006273078B1

(12) United States Patent
Schwesinger

(10) Patent No.: US 6,273,078 B1
(45) Date of Patent: Aug. 14, 2001

(54) POWERED BOW HAVING INTERNAL ENERGY STORAGE

(76) Inventor: Davis Schwesinger, P.O. Box 138, 130 Holden Rd., Pine City, NY (US) 14871

( * ) Notice: Subject to any disclaimer, the term of this patent is extended or adjusted under 35 U.S.C. 154(b) by 0 days.

(21) Appl. No.: 09/491,659

(22) Filed: Jan. 27, 2000

Related U.S. Application Data

(60) Provisional application No. 60/117,859, filed on Jan. 29, 1999.

(51) Int. Cl.[7] ..... F41B 7/00

(52) U.S. Cl. ..... 124/16; 124/27; 124/61

(58) Field of Search ..... 124/16, 20.1, 25, 124/26, 27, 61

(56) References Cited

U.S. PATENT DOCUMENTS 824,506 * 6/1906 Obiols ..... 124/16 X
1,434,768 * 11/1922 Boggess ..... 124/16 X
3,509,863 * 5/1970 Barker ..... 124/16
4,041,927 * 8/1977 Van House ..... 124/16 X
4,169,456 * 10/1979 Van House ..... 124/25 X
4,756,295 * 7/1988 Guzzetta ..... 124/16
5,243,955 * 9/1993 Farless ..... 124/20.1

* cited by examiner

*Primary Examiner*—John A. Ricci
(74) *Attorney, Agent, or Firm*—Brown & Michaels, PC

(57) ABSTRACT

A powered bow for launching a projectile includes a stock, a grip, and a body portion. The body portion includes a groove for receiving and supporting the projectile, a carriage slidably mounted in the body portion, an energy storing device, an energy releasing assembly coupling the carriage with the energy storing device, a latch releasably engaged with the carriage, and a trigger coupled to the latch. The projectile, such as an arrow or a bolt, is propelled by stored energy in the form of compressed fluid, such as air or gas, or springs or the like, the energy being coupled to the arrow by means of a portion of a cable, belt or chain carried on the carriage or pusher riding in a slot and actuated by the cable, belt or chain. The energy storage and release mechanism of the bow is internal to the bow, and the arrow is consistently propelled in a straight line, without safety concerns from sweeping strings or bow arms.

10 Claims, 2 Drawing Sheets

POWERED BOW HAVING INTERNAL ENERGY STORAGE

REFERENCE TO PROVISIONAL APPLICATION

This application claims an invention which was disclosed in Provisional Application Number 60/117,859, filed Jan. 29, 1999, entitled "POWERED BOW HAVING INTERNAL ENERGY STORAGE". The benefit under 35 USC §119(e) of the United States provisional application is hereby claimed, and the aforementioned application is hereby incorporated herein by reference.

FIELD OF THE INVENTION

The invention pertains to the field of archery. More particularly, the invention pertains to a powered bow, especially for projectiles such as arrows and bolts, in which the projectile is propelled by stored energy provided by compressed fluid, springs or the like.

BACKGROUND OF THE INVENTION

The term "bow" is used herein to mean a "mechanical accelerating device for projectiles," covering hand bows for accelerating arrows as well as crossbows for accelerating arrows, bolts or balls as well as all other devices in which a projectile is accelerated with the aid of bows. Subdividing the projectiles by their length and their weight distribution into arrows, bolts and balls is of no importance for the present invention. Accordingly, in the following the term "arrow" or "arrows" which is often used alone includes all other projectiles.

Crossbows have long been known to the art—the traditional design dates back to the $14^{th}$ century or earlier, when very high powered crossbows were effective even against armored horsemen. Modern crossbows now use sighting mechanisms of various sorts, but otherwise are little changed except in style and constructional materials. Draw weights are dramatically lower. A large medieval crossbow of circa 1500 AD might have a draw weight of 1200 lbs and a range of 450 yards. These days crossbows rarely exceed 150 lbs draw weight. The basic elements are a short, horizontally mounted bow, a trigger mechanism (latch) to hold back the string, and the arrow (called 'bolt' or 'quarrel') which sits in a groove. Crossbows normally use rifle style stocks; indeed, the modern rifle design originated with the medieval crossbow. Sights may be aperture sights as found on a rifle, pin sights as on a compound handbow, or telescopic sights. A modern 165 1b draw weight heavyweight crossbow will achieve similar projectile speeds to a 60 lb peak draw weight compound hand bow, and the bolt and arrow weights are also similar (30 gms).

The bow, being relatively short compared to a vertical bow, will require comparatively more force to bend the bow. Indeed, most crossbows must be cocked by using the feet and legs, or mechanical levers or screws in older times for very powerful bows. Because of the large amount of force applied, there are safety concerns created by the structure of a conventional crossbow. The bowstring, being external, sweeps along the top of the bow. A crossbow shooter who sticks a thumb too high will risk injury from the moving string. The bow limbs themselves stick out to the sides of the bow, and pose additional safety concerns. If they hit a tree trunk or similar immovable object, there is a large potential for damage to the archer and the crossbow as the limb suddenly stops and accelerates the buttstock sideways.

In addition, the use of the bow and string introduce elements of inaccuracy, unless the arrow is exactly centered on the string, and the crossbow is cocked consistently in the same place, and as close to center as possible. Cocking the bow even 1/16" off center will drastically change the crossbow's point of impact.

SUMMARY OF THE INVENTION

Briefly stated, a powered bow for launching a projectile includes a stock, a grip, and a body portion. The body portion includes a groove for receiving and supporting the projectile, a carriage or pusher slidably mounted in the body portion, an energy storing device, an energy releasing assembly coupling the carriage with the energy storing device, a latch releasably engaged with the carriage, and a trigger coupled to the latch. The projectile, such as an arrow or a bolt, is propelled by stored energy in the form of compressed fluid, such as air or gas, or springs or the like, the energy being coupled to the arrow by means of the carriage or pusher riding in a slot and actuated by a cable, belt or chain. The energy storage and release mechanism of the bow is internal to the bow, and the arrow is consistently propelled in a straight line, without safety concerns from sweeping strings or bow arms.

According to the invention, a powered bow for launching a projectile includes a stock, a grip, and a body portion. The body portion includes a groove for receiving and supporting the projectile, the groove including a top portion for receiving the projectile and a bottom portion including a slot, a carriage, slidably mounted in the slot, including a front surface for contacting a rear portion of the projectile, an energy storing device energy comprising a gas cylinder, the gas cylinder including a piston coupled to a ram, a first pulley assembly mounted on the ram, a second pulley assembly fixedly mounted on the body portion, a tensioner mounted on a front end of the body, a cable running on the first and second pulley assemblies coupled to the carriage and to the tensioner, a latch releasably engaged with the carriage, and a trigger coupled to the latch. The first and second pulley assemblies each includes a pair of pulleys, the carriage includes an opening sized to receive the projectile, and the cable is coupled to the carriage and includes a portion across the opening for contacting a rear portion of the projectile.

DESCRIPTION OF THE PREFERRED EMBODIMENTS

Figure 1:
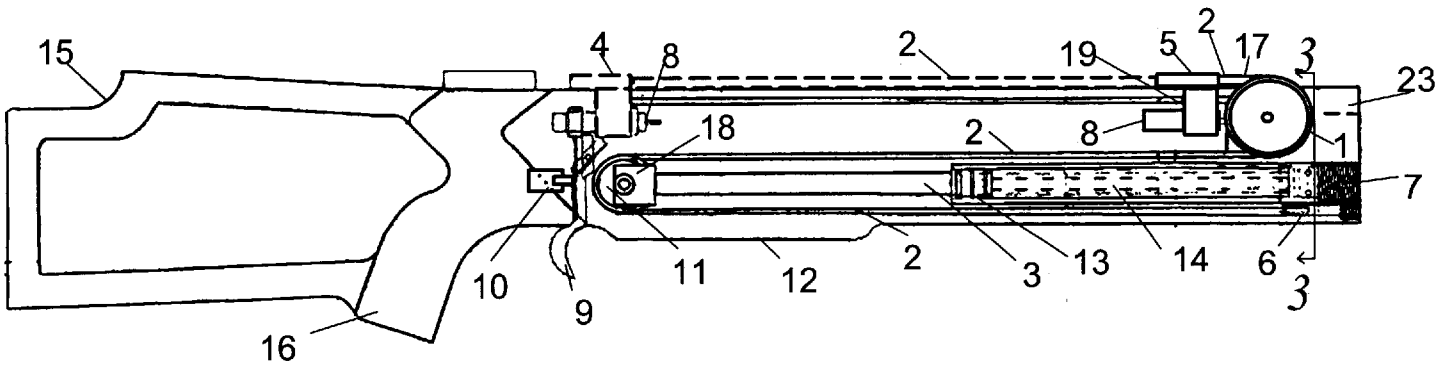
FIG. 1 shows a side cut-away view of the bow of the invention.
Figure 2:
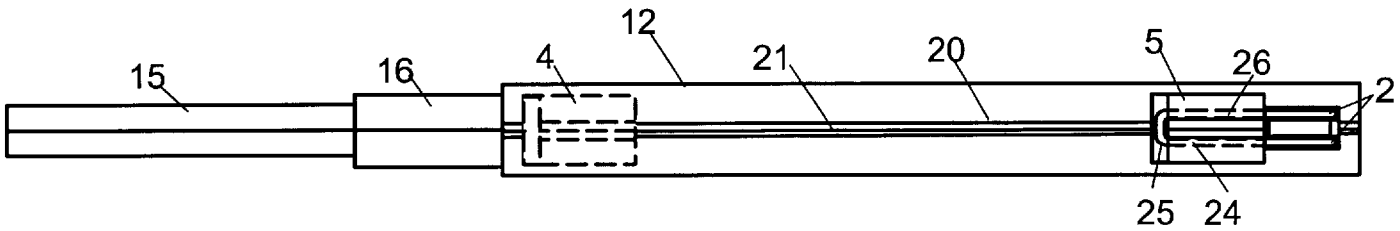
FIG. 2 shows a top view of the bow of the invention.
Figure 3:
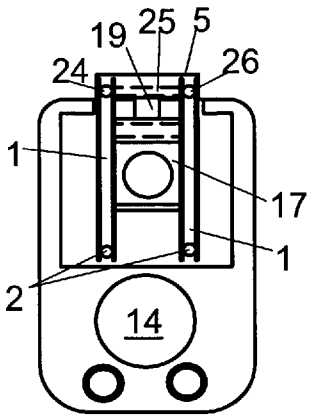
FIG. 3 shows a sectional view of the invention, along the lines 3—3 in FIG. 1.

Referring to FIGS. 1 through 4, the bow of the invention has a stock (15) and grip (16) portion, similar to crossbows or rifles, to allow the archer to hold and aim the weapon. A trigger (9) and latch mechanism (10) allow the weapon to be cocked and fired in much the same way as a conventional crossbow. The trigger (9) is preferably a hydraulically-actuated trigger. A body portion (12) contains the trigger (9) and an energy storage and release mechanism, to be described below, and supports the arrow in an arrow groove (20) located in a top surface 22 of the body (12) as the archer prepares to fire. The arrow is propelled along the groove (20)

by a portion of a cable, belt or chain (2) carried by a carriage or pusher (5) connected to a tab (19) riding in a slot (21) in the bottom of the groove (20), which moves from a rearward, cocked, position (dotted lines (4)) to the forward position in which it is shown in FIGS. 1 and 2.

The energy for propelling the carriage (5) is provided by an energy storage device, preferably a gas cylinder (14) in which rides a piston (13) attached to a ram (3). A fill valve (7) permits pre-pressurizing the cylinder (14) with air, $CO_2$, or other fluid. At the opposite end of the ram (3) is a bracket (18) on which is mounted one or more pulleys (11). Another set of pulleys (1) is mounted on a fixed mount (17) at a front end (23) of the bow, under the forward end of the slot (21). A cable or belt (2) is connected to a tensioner (6) at the front end (23) of the bow, under the gas cylinder (14), and runs in a sinuous route over the movable pulleys (11) on the ram (3), back over the pulleys (1), and is fastened at the other end to the carriage (5). The cable or belt (2) is preferably a single length that is threaded on one pulley of the fixed pair of pulleys (1), through a first bore (24) in the carriage (5), across an upper, centered opening (25) in the carriage (5) sized to accommodate a rear portion of the projectile, through a second bore (26) in the carriage (5), and onto the other pulley of the pair of pulleys (1).

As can be seen in FIG. 1, when the bow is uncocked, the carriage (5) is in its furthest-forward position. To cock the bow, the carriage (5) is pulled back toward its cocked position (4), which pulls the cable (2) through pulleys (1) and (11), and forces the ram (3) to push the piston (13) back into the cylinder (14), compressing the gas inside. When the carriage (5) reaches the fully cocked position (4), it is latched in place by the latch mechanism. At that point, an arrow can be laid in the groove (20), its rear resting against the portion of the cable or belt (2) across the opening (25) in the carriage (5).

The archer aims and pulls the trigger (9), which causes the latching mechanism (10) to release the carriage (5). The force of the compressed gas in the cylinder (14) pushes the piston (13) outward (rearward), pushing on the ram (5). This causes the pulleys (11) to move, which applies force to the cable (2), pulling the carriage (5) forward and propelling the arrow with great force. Preferably, a shock-absorbing snubber (8) is mounted on the tab (17), hitting on the body structure to reduce the shock when the carriage reaches the end of its travel. Alternatively, the snubber (8) could be mounted to the body, and would contact the carriage or tab as it reaches the end of its travel.

Figure 4:
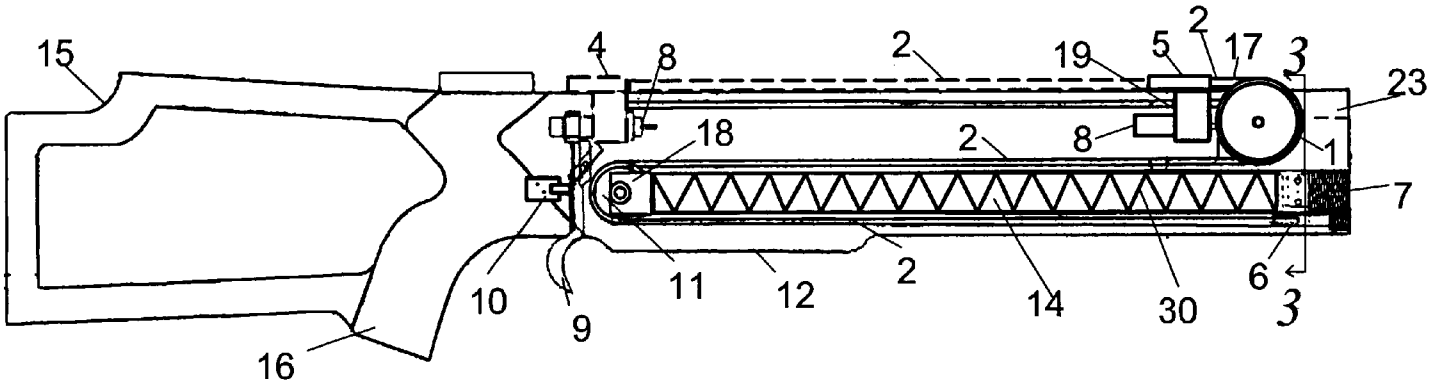
FIG. 4 shows a side cut-away view of the invented bow with a spring for energy storage.

If desired, the cable or belt (2) could be replaced by a chain, in which case the pulleys (1) and (11) could be replaced by sprockets. Referring to FIG. 4, a spring (30) could be placed in the cylinder (14), storing energy in mechanical form in the spring instead of as compressed air.

Accordingly, it is to be understood that the embodiments of the invention herein described are merely illustrative of the application of the principles of the invention. Reference herein to details of the illustrated embodiments are not intended to limit the scope of the claims in the conventional utility patent based upon this provisional application, which will themselves recite those features regarded as essential to the invention.

What is claimed is:

1. A powered bow for launching a projectile, comprising:
a stock;
a grip;
a body portion, said body portion including:
a groove for receiving and supporting the projectile;
a carriage slidably mounted in said body portion;
an energy storing device comprising a gas cylinder, said gas cylinder including a piston coupled to a ram;
an energy releasing assembly coupling the carriage with the energy storing device, said energy releasing assembly comprising a first pulley assembly mounted on said ram, a second pulley assembly fixedly mounted on said body portion, and a cable running on said first and second pulley assemblies, wherein the carriage includes an opening sized to receive the projectile, and wherein the cable is coupled to the carriage and includes a portion across the opening for contacting a rear portion of the projectile, and wherein each of said first and second pulley assemblies comprises a pair of pulleys;
a latch releasably engaged with the carriage; and
a trigger coupled to the latch; and
a tensioner connected to the cable.

2. A bow as in claim 1, wherein the body portion includes a top surface in which is positioned said groove.

3. A bow as in claim 1, wherein the latch is a hydraulic-actuated latch.

4. A powered bow for launching a projectile, comprising:
a stock;
a grip; and
a body portion, said body portion including:
a groove for receiving and supporting the projectile, said groove including a top portion for receiving the projectile and a bottom portion including a slot;
a carriage, slidably mounted in said slot, including a front surface for contacting a rear portion of said projectile;
an energy storing device energy comprising a gas cylinder, said gas cylinder including a piston coupled to a ram;
a first pulley assembly mounted on said ram;
a second pulley assembly fixedly mounted on said body portion;
a tensioner mounted on a front end of the body;
a cable running on said first and second pulley assemblies coupled to the carriage and to the tensioner;
a latch releasably engaged with the carriage; and
a trigger coupled to the latch.

5. A bow as in claim 4, wherein the first and second pulley assemblies each comprises a pair of pulleys, the carriage includes an opening sized to receive the projectile, and the cable is coupled to the carriage and includes a portion across the opening for contacting a rear portion of the projectile.

6. A bow as in claim 4, wherein the body portion includes a top surface and said groove is located in said top surface.

7. A bow as in claim 4, wherein the cable includes a loop located along the front surface of the carriage for contacting the rear portion of the projectile.

8. A bow as in claim 4, wherein the latch is a hydraulic-actuated latch.

9. A powered bow for launching a projectile, comprising:
a stock;
a grip;
a body portion, said body portion including:
a groove for receiving and supporting the projectile;
a carriage slidably mounted in said body portion;
an energy storing device comprising a spring, said spring being coupled to a first pulley assembly;
an energy releasing assembly coupling the carriage with the energy storing device, said energy releasing assembly comprising the first pulley assembly coupled to the spring, a second pulley assembly fixedly mounted on said body portion, and a cable running on said first and second pulley assemblies, wherein the carriage includes an opening sized to receive the projectile, and wherein the cable is coupled to the carriage and includes a portion across the opening for contacting a rear portion of the projectile, and wherein each of said first and second pulley assemblies comprises a pair of pulleys;

a latch releasably engaged with the carriage; and a trigger coupled to the latch; and a tensioner connected to the cable.

10. A powered bow for launching a projectile, comprising:

a stock;

a grip;

a body portion, said body portion including:

a groove for receiving and supporting the projectile;

a carriage slidably mounted in said body portion;

an energy storing device comprising a gas cylinder, said gas cylinder including a piston coupled to a ram;

an energy releasing assembly coupling the carriage with the energy storing device, said energy releasing assembly comprising a first pulley assembly mounted on said ram, a second pulley assembly fixedly mounted on said body portion, and a belt running on said first and second pulley assemblies, wherein the carriage includes an opening sized to receive the projectile, and wherein the belt is coupled to the carriage and includes a portion across the opening for contacting a rear portion of the projectile, and wherein each of said first and second pulley assemblies comprises a pair of pulleys;

a latch releasably engaged with the carriage; and a trigger coupled to the latch; and a tensioner connected to the belt.

* * * * *